US011287180B2

(12) United States Patent
Lee et al.

(10) Patent No.: US 11,287,180 B2
(45) Date of Patent: Mar. 29, 2022

(54) REFRIGERATOR AND METHOD FOR CONTROLLING THE SAME

(71) Applicant: LG Electronics Inc., Seoul (KR)

(72) Inventors: Sunghun Lee, Seoul (KR); Dongjeong Kim, Seoul (KR); Seungyoon Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 38 days.

(21) Appl. No.: 16/201,192

(22) Filed: Nov. 27, 2018

(65) Prior Publication Data

US 2019/0162467 A1 May 30, 2019

(30) Foreign Application Priority Data

Nov. 27, 2017 (KR) ..... 10-2017-0159262

(51) Int. Cl.
*F25D 29/00* (2006.01)
*F25D 11/02* (2006.01)
(Continued)

(52) U.S. Cl.
CPC ..... *F25D 29/003* (2013.01); *E05F 15/619* (2015.01); *F25D 11/02* (2013.01);
(Continued)

(58) Field of Classification Search
CPC ..... F25D 29/003; F25D 29/006; F25D 11/02; F25D 23/025; F25D 23/028; F25D 23/027; F25D 2323/02; F25D 2325/021; F25D 2700/02; E05F 15/619; E05Y 2400/32; E05Y 2400/322; E05Y 2400/334; E05Y 2900/31
(Continued)

(56) References Cited

U.S. PATENT DOCUMENTS 5,912,541 A * 6/1999 Bigler ..... H02K 11/215 318/538
7,042,188 B2 * 5/2006 Miura ..... H02K 11/33 318/400.09
(Continued)

FOREIGN PATENT DOCUMENTS

JP 2015055130 3/2015
WO WO 2016/200050 * 12/2016

*Primary Examiner* — Daniel J Troy
*Assistant Examiner* — Timothy M Ayres
(74) *Attorney, Agent, or Firm* — Fish & Richardson P.C.

(57) ABSTRACT

A refrigerator includes: a cabinet in which a storage compartment is formed; a refrigerator door for opening and closing the storage compartment; a rack which can move from an initial position to a door opening position to open the refrigerator door; a driving motor which generates a driving force to move the rack; a power transmission unit which transmits power of the driving motor to the rack; a rotation detection unit which detects a rotation number of the driving motor; and a controller that controls the driving motor based on information on the rotation number detected by the rotation detection unit, in which the controller may control the driving motor to a first state until the rack moves from the door opening position to a reference position and may control the driving motor to a second state until the rack moves from the reference position to the initial position.

6 Claims, 9 Drawing Sheets

(51) Int. Cl.
*F25D 23/02* (2006.01)
*F25D 25/02* (2006.01)
*E05F 15/619* (2015.01)

(52) U.S. Cl.
CPC ..... *F25D 23/025* (2013.01); *F25D 23/028* (2013.01); *F25D 25/027* (2013.01); *F25D 29/005* (2013.01); *F25D 29/006* (2013.01); *E05Y 2400/32* (2013.01); *E05Y 2400/322* (2013.01); *E05Y 2400/334* (2013.01); *E05Y 2900/31* (2013.01); *F25D 2323/02* (2013.01); *F25D 2325/021* (2013.01); *F25D 2700/02* (2013.01)

(58) Field of Classification Search
USPC ..... 312/405
See application file for complete search history.

(56) References Cited

U.S. PATENT DOCUMENTS 7,107,721 B2 * 9/2006 Sato ..... E05B 47/02 49/281
7,166,981 B2 * 1/2007 Kakutani ..... H02K 3/522 318/567
7,617,034 B2 * 11/2009 Suzuki ..... B60J 7/0573 701/49
8,067,915 B2 * 11/2011 Hooker ..... A47B 88/457 318/466
8,274,251 B2 * 9/2012 Yoo ..... F25D 25/025 318/466
8,297,725 B2 * 10/2012 Kim ..... F25D 23/028 312/405
8,454,102 B2 * 6/2013 Kim ..... E05F 15/619 312/319.5
8,476,858 B2 * 7/2013 Eom ..... F25D 25/025 318/466
8,497,644 B2 * 7/2013 Eom ..... A47B 88/40 318/266
9,695,624 B2 * 7/2017 Heydel ..... F25D 25/025
10,054,362 B2 * 8/2018 Chang ..... E05F 15/619
10,132,555 B2 * 11/2018 Yasaka ..... E05F 15/614
10,174,540 B2 * 1/2019 Heydel ..... E05F 15/619
10,202,792 B2 * 2/2019 Kim ..... E05F 15/619
10,280,673 B2 * 5/2019 Shin ..... E05F 15/73
10,301,865 B2 * 5/2019 Son ..... E05F 15/75
10,309,143 B2 * 6/2019 Eom ..... F25D 23/028
10,577,843 B2 * 3/2020 Lee ..... F25D 23/028
2006/0279243 A1 * 12/2006 Schachtl ..... E05F 15/611 318/466
2014/0304942 A1 * 10/2014 Li ..... E05F 15/614 16/64
2017/0260794 A1 * 9/2017 Son ..... E06B 7/215
2018/0038626 A1 * 2/2018 Kim ..... F21V 19/0015
2018/0038634 A1 * 2/2018 Kim ..... F21V 19/0015
2018/0038637 A1 * 2/2018 Kim ..... F25D 29/005
2018/0119475 A1 * 5/2018 Kim ..... E05F 15/614
2018/0187470 A1 * 7/2018 Song ..... F25D 23/028
2018/0347892 A1 * 12/2018 Kim ..... F25D 23/087
2019/0162006 A1 * 5/2019 Lee ..... E05F 15/73
2019/0169910 A1 * 6/2019 Im ..... F25D 23/028
2019/0330909 A1 * 10/2019 Lee ..... E05F 15/79
2020/0095818 A1 * 3/2020 Lee ..... F25D 29/00
2020/0131835 A1 * 4/2020 Cheng ..... E05F 15/619

* cited by examiner

REFRIGERATOR AND METHOD FOR CONTROLLING THE SAME

CROSS-REFERENCE TO RELATED APPLICATIONS

This application claims the benefit of the Korean Patent Application No. 10-2017-0159262 filed on Nov. 27, 2017, which is hereby incorporated by reference as if fully set forth herein.

BACKGROUND

The present disclosure relates to a refrigerator and method for controlling the refrigerator.

A refrigerator is a home appliance that can keep objects such as food in a storage compartment provided in a cabinet at a low temperature. The storage compartment may be surrounded by an insulation wall so that the internal temperature of the storage compartment is maintained at a temperature lower than an external temperature.

The storage compartment may be referred to as a refrigerating compartment or a freezing compartment according to the temperature range of the storage compartment.

A user may open and close the storage compartment using a door. The user opens the door so as to put objects into the storage compartment or take objects out of the storage compartment. In some examples, the door is rotatably provided on the cabinet and a gasket is provided between the door and the cabinet.

In some cases, in a state of closing the door, the gasket is closely adhered between the door and the cabinet to prevent leakage of cool air from the storage compartment. As adhesion force of the gasket increases, the effect of preventing leakage of cool air may increase.

So as to increase adhesion force of the gasket, the gasket may be formed of, for example, a rubber magnet or a magnet may be provided in the gasket. However, if adhesion force of the gasket increases, a large force may be required to open the door.

Recently, refrigerators having an auto closing function have been provided. For example, an auto closing function refers to a function for automatically closing the door of the refrigerator using adhesion force and magnetic force of the gasket and elastic force of a spring when the door of the refrigerator is slightly opened.

In some examples, the auto closing function refers to a function for preventing the door of the refrigerator from being automatically opened even when the refrigerator is slightly tilted forward.

In some cases, the refrigerators may require a large force to open a door because a user may pull the door with force larger than adhesion force and magnetic force of a gasket and elastic force of a spring.

Recently, a door opening device for automatically opening a door has been proposed.

Japanese Unexamined Patent Publication No. 2015-55130, which is the related art document, discloses an opening device for opening a refrigerator door.

The opening device includes a first protrusion component that pushes out a first door, a second protrusion component that pushes out a second door, a motor that can rotate in the forward and reverse directions, and a plurality of detection means that detects states of the first protrusion component and the second protrusion component.

This related art document determines the states of the first protrusion component and the second protrusion component based on the on or off states of the plurality of detection means.

According to the related art document, since the number of components increases by detecting the states of the protrusion components by using a plurality of detection means and a plurality of detection means are installed without interfering with the motor or the gear, there is a disadvantage that an installation structure is complex.

SUMMARY

The present embodiment provides a refrigerator and a method for controlling the same that can grasp the position of a rack which operates for door opening without a sensor.

In addition, the present embodiment also provides a refrigerator and a method for controlling the same that can accurately move the rack to the initial position after the rack moves to the door opening position.

In addition, the present embodiment provides a refrigerator which can reduce noise generated in the process of moving the rack to the initial position.

A refrigerator includes: a cabinet in which a storage compartment is formed; a refrigerator door which is connected to the cabinet for opening and closing the storage compartment; a rack which can move from an initial position to a door opening position to open the refrigerator door; a driving motor which generates a driving force to move the rack; a power transmission unit which transmits power of the driving motor to the rack; a rotation detection unit which detects a rotation number of the driving motor; and a controller that controls the driving motor based on information on the rotation number detected by the rotation detection unit.

The controller may control the driving motor to a first state until the rack moves from the door opening position to a reference position and may control the driving motor to a second state until the rack moves from the reference position to the initial position.

The reference position may be set to a position between the door opening position and the initial position.

The first state is a state where the driving motor rotates at a first reference speed in one direction and the second state is a state where the driving motor rotates at a second reference speed which is slower than the first reference speed in the one direction.

In a state where the rack is positioned at the door opening position, when the driving motor rotates in one direction, if an accumulated rotation number detected by the rotation detection unit reaches a reference rotation number, the controller may determine that the rack moves to the reference position.

In a process of moving the rack from the reference position to the initial position, if the rotation number of the driving motor detected by the rotation detection unit per unit time is equal to or less than a stop reference number, the controller may determine that the rack moves to the initial position and may stop the driving motor.

In this embodiment, the door opening device may further include a housing for accommodating the rack, and the housing may include a stopper which is in contact with the rack at an initial position of the rack.

The initial position may be set to a position between the door opening position and the reference position.

The first state may be a state where the driving motor rotates in one direction, and the second state may be a state where the driving motor rotates in the other direction which is an opposite direction to the one direction.

In a state where the rack is positioned at the door opening position, when the driving motor rotates in one direction, if the rotation number detected by the rotation detection unit per unit time reaches the stop reference number, the controller may determine that the rack moves to the reference position.

If the controller determines that the rack moves to the reference position, the controller may stop the driving motor after operating the driving motor until the rotation number of the driving motor in the other direction reaches a predetermined rotation number.

In a process of rotating of the driving motor in one direction, the controller may reduce the speed of the driving motor before the rack reaches the reference position.

In a state where the rack is positioned at the door opening position, when the driving motor rotates in one direction when the accumulated rotation number detected by the rotation detection unit reaches the reference rotation number, the controller reduces the speed of the driving motor.

According to another aspect of the present invention, there is provided a method for controlling a refrigerator which includes a rack which opens a door, a driving motor which generates a driving force to move the rack, and a controller which controls the driving motor, the method including: rotating the driving motor in a first direction so that the rack moves from an initial position to a door opening position so as to open the door; stopping the driving motor when the rack moves to the door opening position; rotating the driving motor at a first reference speed in a second direction which is an opposite direction to the first direction so as to move the rack to the initial position; determining whether or not the rack reaches a reference position before reaching the initial position; rotating the driving motor at a second reference speed which is slower than the first reference speed in the second direction in a case where the rack reaches the reference position; and stopping the driving motor when it is determined that the rack reaches the initial position.

The controller may stop the driving motor when the accumulated rotation number of the driving motor reaches a first reference rotation number when the driving motor rotates in the first direction.

When the driving motor rotates at the first reference speed in the second direction so that the rack moves from the door opening position to the initial position, if the accumulated rotation number of the driving motor reaches a second reference rotational number that is smaller than the first reference rotation number, the controller determines that the rack moves to the reference position.

In a process of moving the rack from the reference position to the initial position, if the rotation number of the driving motor per unit time reaches a stop reference number, the controller may determine that the rack moves to the initial position and may stop the driving motor.

According to another aspect of the present invention, there is provided a method for controlling a refrigerator which includes a rack which opens a door, a driving motor which generates a driving force to move the rack, and a controller which controls the driving motor, the method including: rotating the driving motor in a first direction so that the rack moves from an initial position to a door opening position so as to open the door, stopping the driving motor when the rack moves to the door opening position, rotating the driving motor in a second direction which is an opposite direction to the first direction so as to move the rack to the initial position, determining whether or not the rack reaches the reference position, rotating the driving motor again in the first direction in a case where the rack reaches the reference position, and stopping the driving motor when it is determined that the rack reaches the initial position.

In a process of moving the rack from the initial position to the door opening position so as to open the door, when the driving motor rotates in the first direction, if accumulated rotation number of the driving motor reaches the first reference rotation number, the controller may stop the driving motor.

In a process of moving the rack from the door opening position to the reference position, if the rotation number of the driving motor per unit time reaches a stop reference number, the controller may stop the driving motor.

In a process of again rotating the driving motor in the first direction, if the accumulated rotation number of the driving motor reaches a predetermined rotation number, the controller may stop the driving motor.

DETAILED DESCRIPTION OF THE DISCLOSURE

Figure 1:
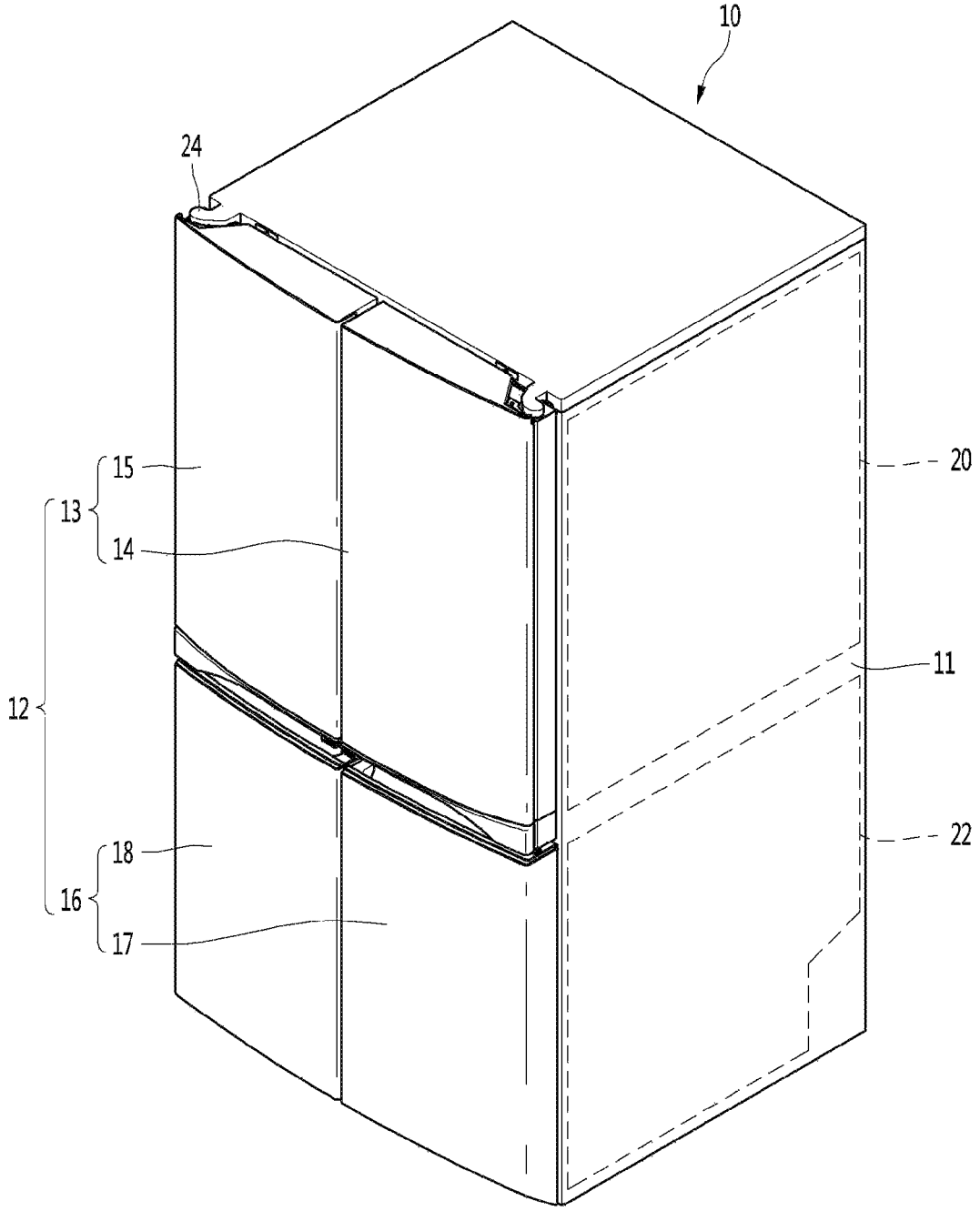
FIG. 1 is a perspective view of a refrigerator according to an embodiment of the present invention.
Figure 2:
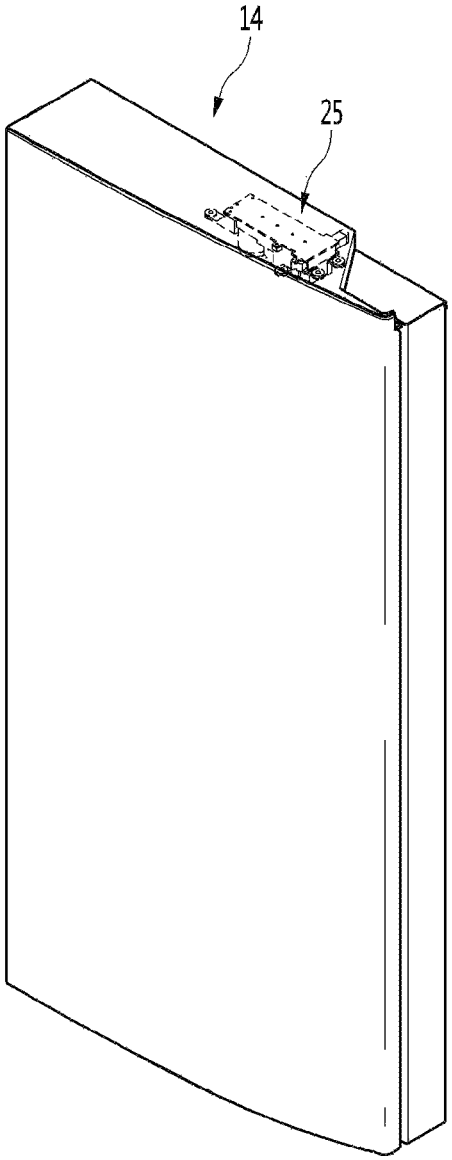
FIG. 2 is a perspective view illustrating a state where a door opening device is provided to a door according to an embodiment of the present invention.

FIG. 1 is a perspective view of a refrigerator according to an embodiment of the present invention and FIG. 2 is a perspective view illustrating a state where a door opening device is provided to a door according to an embodiment of the present invention.

With reference to FIG. 1 and FIG. 2, a refrigerator 10 according to an embodiment of the present invention may include a cabinet 11 that forms a storage compartment, and a door 12 that opens and closes the storage compartment.

The storage compartment may include a refrigerating compartment 20 and a freezing compartment 22, for example. The refrigerating compartment 20 may be positioned above the freezing compartment 22, although not limited thereto. The freezing compartment 22 and the refrigerating compartment 20 may be also disposed to the left and right according to the shape of the refrigerator and the freezing compartment 22 may be also positioned above the refrigerating compartment 20.

The door 12 may include a refrigerating compartment door 13 for opening and closing the refrigerating compartment 20 and a freezing compartment door 16 for opening and closing the freezing compartment 22.

The refrigerating compartment door 13 may include a pair of doors 14 and 15 disposed to the left and right. The freezing compartment door 16 may include a pair of doors 17 and 18 disposed to the left and right.

The door 12 may be rotatably connected to the cabinet 11 by a hinge 24.

However, in this embodiment, there is no limitation on the number and disposition of the refrigerating compartment door 13 and the freezing compartment door 16.

The door 12 may include a door opening device 25 for automatically opening the door 12 without applying a force to the door 12.

The door opening device 25 may be installed on the door 12 that is required to be automatically opened. In FIG. 2, for example, a door opening device 25 is provided in a first refrigerating compartment door 14 of the refrigerating compartment door 13.

The door opening device 25 is driven under predetermined conditions or states, and the door is automatically opened by the driving of the door opening device 25. Therefore, the force required for the user to open the door is not significantly reduced or the force is not required.

For example, in a case where the sensor recognizes access of the user, the user presses a specific button, or the user inputs an open command through a touch-type input unit, the door opening device 25 can be operated.

Hereinafter, the door opening device 25 will be described in detail.

Figure 3:
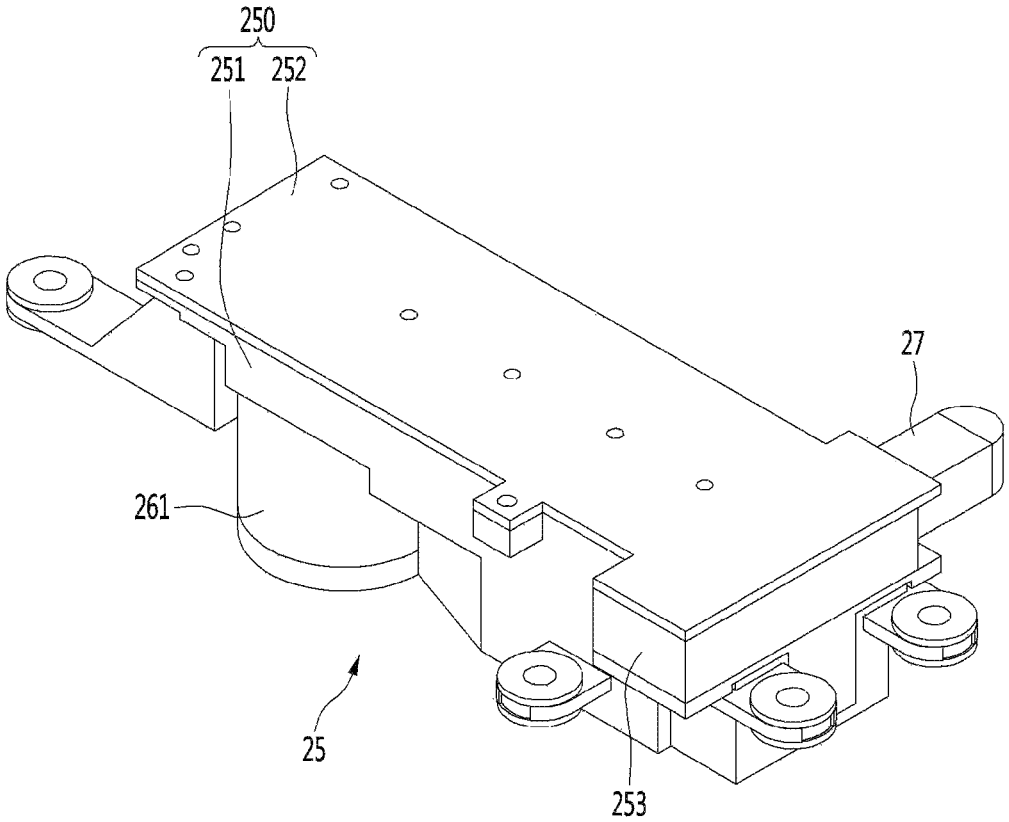
FIG. 3 is a perspective view of a door opening device according to an embodiment of the present invention.
Figure 4:
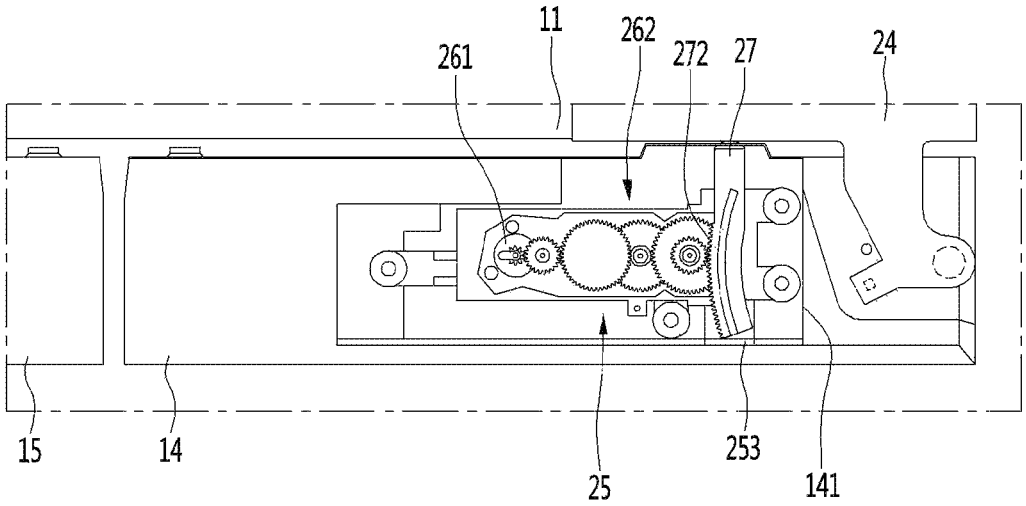
FIG. 4 is a view illustrating a structure of a door opening device installed in a door.
Figure 5:
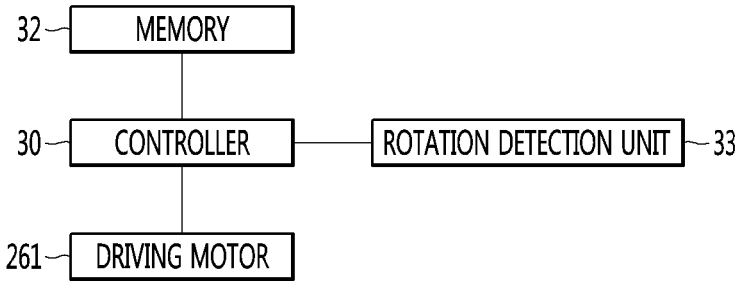
FIG. 5 is a block diagram of a refrigerator of the present invention.

FIG. 3 is a perspective view of a door opening device according to an embodiment of the present invention, FIG. 4 is a view illustrating a structure of a door opening device installed in the door, and FIG. 5 is a block diagram of a refrigerator of the present invention.

With reference to FIG. 3 to FIG. 5, the door opening device 25 may be positioned on the upper portion of the door requiring opening.

FIG. 4 illustrates that a door opening device 25 is installed in the first refrigerating compartment door 14, as an example.

The upper portion of the first refrigerating compartment door 14 may be provided with a frame 141 for forming a space for accommodating the door opening device 25. The frame 141 may define a space in which the heat insulating material (not illustrated) is accommodated in the first refrigerating compartment door 14 and a space in which the door opening device 25 is accommodated.

The door opening device 25 may include a housing 250 which is accommodated in the frame 141, a driving motor 261 which is installed on the housing 250 to generate a driving force, a rack 27 which is operated to receive the driving force of the driving motor 261, and a power transmission unit which transmits the driving force of the driving motor 261 to the rack 27.

The housing 250 may include, but is not limited to, a first housing 251 and a second housing 252 coupled to the first housing 251.

The power transmission unit may include one or more gears 262.

In the present embodiment, the number of gears is not limited as long as the power transmitting portion can transmit the power of the driving motor 261 to the rack 27. In FIG. 4, for example, the power transmitting portion includes a plurality of gears.

The rack 27 may include a rack gear 272. The rack gear 272 can engage with the last one of the plurality of gears 262.

The rack gear 272 may be formed in a curved shape so that the length of the rack 27 is reduced. Of course, it is also possible that the rack 27 is formed in a linear shape. Alternatively, the rack 27 may be a multi-stage rack. In other words, the rack 27 may include a first rack and a second rack that move in a stepwise manner. It is to be noted that the shape and the number of the racks 27 are not limited in the present embodiment.

The driving motor 261 is a motor which can rotate in both directions.

The rotating force of the driving motor 261 is transmitted to the rack 27 by the plurality of gears 262 by the rotation of the driving motor 261 in the first direction and according to this, the rack 27 can move in a direction which is drawn out from the door 12 so as to open the door 12.

On the other hand, by the rotation of the driving motor 261 in the second direction, the rotational force of the driving motor 261 is transmitted to the rack 27 by the plurality of gears 262, and according to this, the rack 27 can be drawn into the door 12.

In the present embodiment, the position of the rack 27 waiting for a door opening command in the closed state of the door 12 may be referred to as an initial position. The position of the rack 27 at the position where the opening of the door 12 is completed may be referred to as a door opening position.

In this embodiment, the housing 250 may include a stopper 253 that is in contact with the rack 27 in a state where the rack 27 moves to the initial position.

The stopper 253 may be used to detect that the rack 27 moves to the initial position. The function of the stopper 253 will be described below.

In addition, a position confirmed for moving the rack 27 to the initial position may be referred to as a reference position.

In the present embodiment, the reference position is a position between the initial position and the door opening position.

The rack 27 can move from the initial position to the door opening position by the rotation of the driving motor 261 in the first direction. The rack 27 can move from the door opening position to the initial position by the rotation of the driving motor 261 in the second direction.

The refrigerator 10 may further include a rotation detection unit 33 which detects a rotation state of the driving motor 261, and a controller 30 which controls the driving motor 261 based on information detected by the rotation detection unit 33.

The controller 30 can indirectly determine the position of the rack 27 based on the information detected by the rotation detection unit 33.

The rotation detection unit 33 may be an encoder which detects the rotation number of the driving motor 261, as an example. Alternatively, the rotation detection unit 33 may detect the rotation of one of the plurality of gears 262.

The encoder outputs N pulses during one rotation of the driving motor 261 and the controller 30 can determine the rotation number of the driving motor 261 using the accumulated pulse number of the driving motor 261.

As another example, the controller 30 itself may include a function of detecting the rotation number of the driving motor 261.

The controller 30 can control the position of the rack 27 by detecting the rotation number of the driving motor 261 or the gear without an additional sensor.

The refrigerator 10 may further include a memory 32 in which information on the rotation number (may be referred to as first reference rotation number) of the driving motor 261 required so as to move the rock 27 from the initial position to the door opening position.

In addition, information on rotation number (which may be referred to as a second reference rotation number) for detecting that the rack 27 reaches the reference position can be stored in the memory 32. The second reference rotation number may be set to a value smaller than the first reference rotation number.

Although not limited, the second reference rotation number may be set to a value of 4/5 or more of the first reference rotation number.

Figure 6:
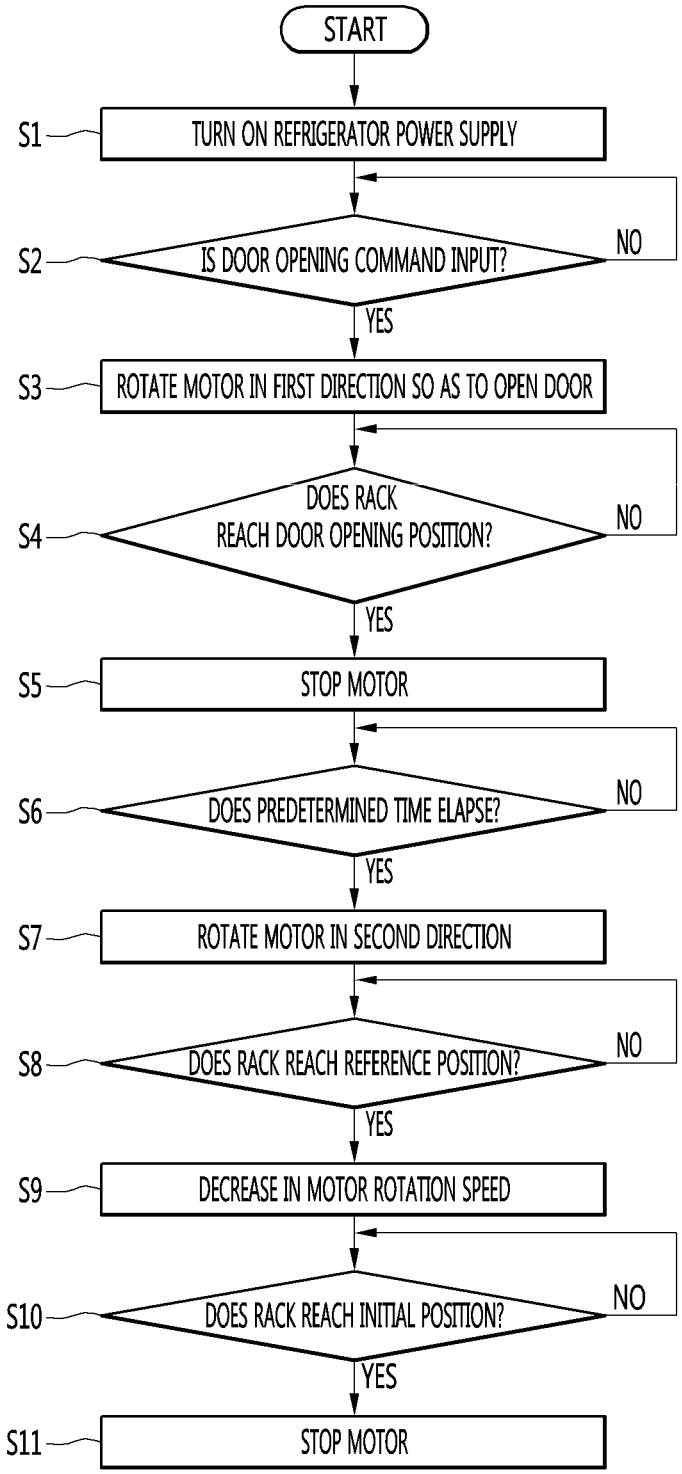
FIG. 6 illustrates a door opening method according to an embodiment of the present invention.
Figure 7:
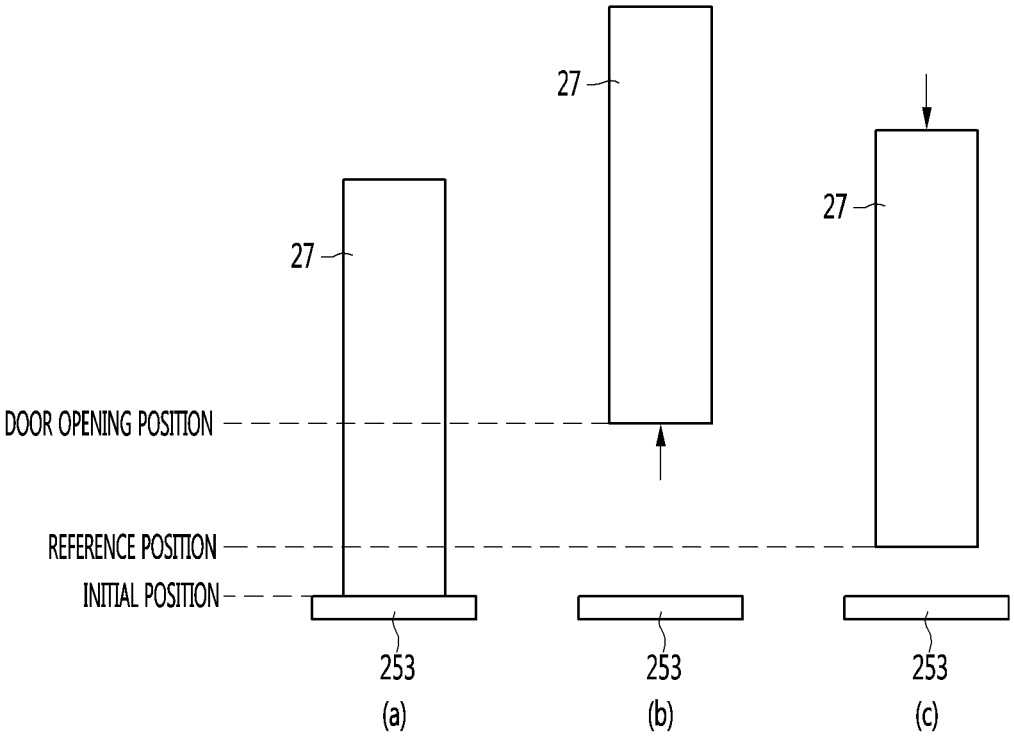
FIG. 7 is a view illustrating a state where the rack moves from the initial position to the door opening position and a state where the rack is returned from the door opening position to the initial position.
Figure 8:
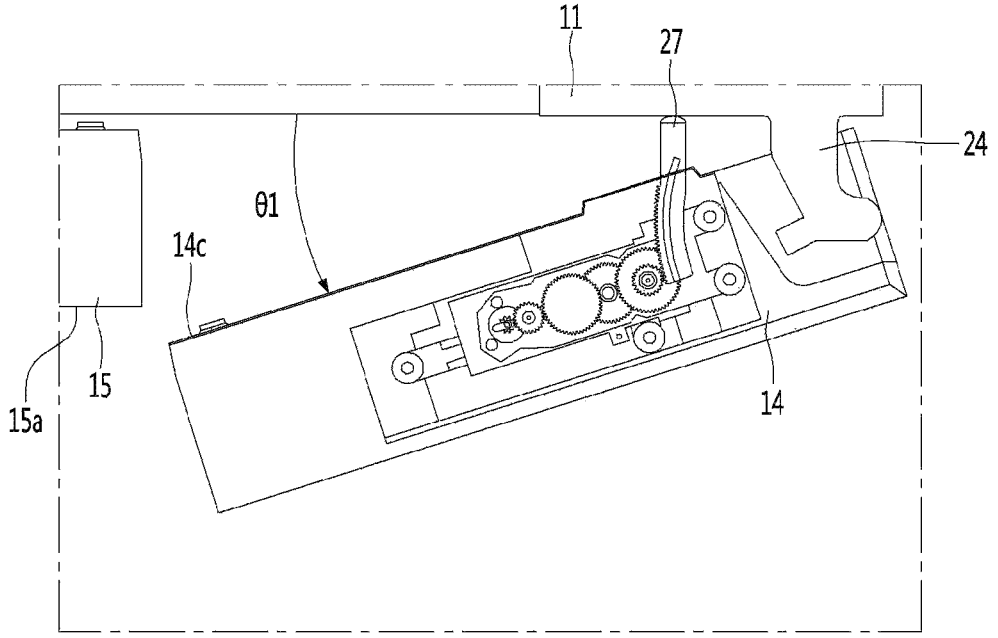
FIG. 8 is a view illustrating a state where a first refrigerating compartment door is opened by a reference angle according to an embodiment of the present invention.

FIG. 6 illustrates a door opening method according to an embodiment of the present invention, FIG. 7 is a view illustrating a state where the rack moves from the initial position to the door opening position and a state where the rack is returned from the door opening position to the initial position, and FIG. 8 is a view illustrating a state where a first refrigerator compartment door is opened by a reference angle according to an embodiment of the present invention.

In FIG. 7, the rack is illustrated in a straight line shape for easy understanding of the movement of the rack.

With reference to FIG. 5 to FIG. 8, when the power of the refrigerator 1 is turned on S1, the controller 30 waits for an input of a door opening command.

When the controller 30 determines that the door opening command is input (S2), the controller 30 controls the driving motor 261 so that the driving motor 261 rotates in the first direction so as to move the rack 27 from the initial position to the door opening position 261 (S3).

When the driving motor 261 rotates in the first direction, the plurality of gears 262 transmit the rotating force of the driving motor 261 in the first direction to the rack 27, the rack 27 pushes the cabinet 11, and the door 12 rotates by the reaction regarding this.

When the driving motor 261 rotates in the first direction, the rotation detection unit 33 detects the rotation number of the driving motor 261.

The controller 30 determines whether or not the rack 27 reaches the door opening position in a process of rotation of the driving motor 261 in the first direction (S4).

For example, the controller 30 can determine whether or not the accumulated rotation number of the driving motor 261 reaches the first reference rotation number in a process of the rotation of the driving motor 261 in the first direction.

When the controller 30 determines that the accumulated rotation number of the driving motor 261 reaches the first reference rotation number, the controller 30 determines that the rack 27 moves to the door opening position (position in (b) of FIG. 7) and stops the rotation of the driving motor 261 (S5).

In the present embodiment, the controller 30 can determine whether or not the driving motor 261 is operated normally or the power transmission unit or the rack 27 moves normally, based on the rotation number detected in a process of the operation of the driving motor 261.

For example, in a case where rotation number (or pulse number) detected per unit time is smaller than the limited rotation number (or limited pulse number), the driving motor 261 may be an abnormal state or a case where the power transmission unit or the rack 27 cannot move normally by obstacle, external load, or the like.

In this case, if the driving motor 261 continues to operate, the rack 27 or the power transmission unit may be damaged, or the driving motor 261 may fail due to an over-current of the driving motor 261.

Therefore, in a case where the rotation number detected for unit time is smaller than the limited rotation number, the controller 30 rotates the motor 261 in the second direction which is an opposite direction to the first direction so that the rack 27 is returned to the initial position. However, a method for accurately returning the rack 27 to the initial position will be described below.

As illustrated in FIG. 8, when the rack 27 reaches the door opening position, at least a portion of the rear surface 14*c* of the first refrigerating compartment door 14 can be positioned at a front side of the front surface 15*a* of the second refrigerating compartment door 15. Accordingly, a gap having a fixed distance may be formed between one end portion of the rear surface 14*c* of the first refrigerating compartment door 14 and one end portion of the front surface 15*a* of the second refrigerating compartment door 15.

The gap may be set to such an extent that the elbow or foot of the user can be inserted, in a case where both hands of the user are not free.

The opening angle of the first refrigerating compartment door 14 may manually increase by inserting the elbow or the foot into the gap while the first refrigerating compartment door 14 rotates by the reference angle θ1.

Meanwhile, the controller 30 determines whether or not a predetermined time elapses at the time point when the rack 27 moves to the door opening position and the driving motor 261 is stopped (S6).

As a result of the determination in step S6, when it is determined that a predetermined time elapses at the time point when the driving motor 261 is stopped, the controller 30 rotates the driving motor 261 in the second direction so as to return the rack 27 to the initial position (S7).

When the motor 261 immediately rotates in the second direction in a state where the rack 27 reaches the door opening position, there is a problem that the door 12 is immediately closed by at least one of the load of the door 12 itself, a magnetic force of a magnet provided in a gasket (not illustrated) for being in close contact with the door 12 and the cabinet 11, and a closing force being generated by an automatic closing mechanism (not illustrated) for automatically closing door.

However, as in the present embodiment, when the driving motor 261 rotates in the second direction after the lapse of the predetermined time in a state where the driving motor 261 is stopped, the opened state of the door 12 can be kept for a predetermined time and the user can further manually rotate the door 12.

So as to return the rack 27 to the initial position, the controller 30 may rotate the driving motor 261 at a first reference speed. At this time, the first reference speed may be the same speed as the rotation speed of the driving motor 261 at the time of the rotation in the first direction.

The rotation number of the driving motor 261 may be detected by the rotation detection unit 33 even in a process of the rotation of the driving motor 261 in the second direction.

The controller 30 determines whether or not the rack 27 reaches the reference position in a process of the rotation of the driving motor 261 in the second direction (S8).

For example, the controller 30 may determine whether or not the accumulated rotation number of the driving motor 261 reaches the second reference rotation number.

In this embodiment, the reason why the second reference rotation number is set to 4/5 or more of the first reference rotation number is to minimize an increase in the return time of the rack 27.

For example, when the second reference rotation number is set to a small value, the operation time of the driving motor 261 is reduced to the first reference speed, and the return speed of the rack 27 is slowed down and thus return time increases.

Accordingly, in this embodiment, an increase in the return time of the rack 27 can be minimized by the speed of the driving motor 261 being reduced at a position where the rack 27 is as close as possible to the reference position.

If it is determined in step S8 that the rack 27 reaches the reference position (see position of (c) in FIG. 7), the controller 30 rotates the driving motor 261 at a second reference speed which is slower than the first reference speed.

In other words, the controller 30 reduces the speed of the driving motor 261 in a case where the rack 27 reaches the reference position (S9).

The controller 30 determines whether or not the rack 27 reaches the initial position (S10).

For example, in a case where the rack 27 is in contact with the stopper 253, it can be determined that the rack 27 is positioned at the initial position (see position of (a) of FIG. 7).

At this time, when the rack 27 is in contact with the stopper 253, the rack 27 cannot move any more, and accordingly, the driving motor 261 cannot rotate. If the driving motor 261 does not rotate, the rotation number of the driving motor 261 may not be detected or the detected rotation number may be extremely small, by the rotation detection unit 33.

Accordingly, The controller 30 determines that the rack 27 moves to the initial position and stops the driving motor 261 when the rotation number of the driving motor 261 per unit time is equal to or less than the stop reference number (S11).

Meanwhile, as described above, in a case where detected rotation number during unit time is smaller than the limited rotation number while the driving motor 261 is operated in the first direction, the driving motor 261 can rotate in the second direction.

In this case, the controller 30 determines whether or not the accumulated rotation number detected when the driving motor 261 rotates in the second direction at the current position of the rack 27 reaches the second stop reference number (accumulated rotation number at the time of direction change of driving motor—N), and determines whether or not the rack 27 reaches the reference position.

At this time, the N can be set as the accumulated rotation number of the driving motor 261 until the rack 27 moves from the initial position to the reference position when the driving motor 261 normally rotates in the first direction.

When it is determined that the rack 27 reaches the reference position, steps S9 to S11 described above may be performed.

According to the present embodiment, the following effects can be expected.

First, since the controller 30 determines the position of the rack 27 based on the rotation number information of the driving motor 261, there is an advantage that an additional sensor is unnecessary and accordingly, a structure of the door opening device becomes simple and the manufacturing cost thereof is reduced.

In addition, there is an advantage that the rack can be accurately returned to the initial position by determining the accumulated rotation number of the driving motor reaches the first reference rotation number, not stopping the driving motor, detecting contacting between the rack and stopper 253, and stopping the driving motor, in a process of returning the rack 27 from the door opening position to the initial position.

If it is determined that the rack moves to the initial position only by comparing the accumulated rotation number with the first reference rotation number of the driving motor 261, there is a problem that the rack 27 cannot move accurately to the initial position for reasons of the idling rotation of the driving motor 261 and the counting error of the rotation number thereof.

However, in a case where the driving motor 261 is stopped at a position where the rack 27 is in contact with the stopper and does not move any more, as in the present embodiment, the rack 27 can accurately move to the initial position.

In addition, according to the present embodiment, the moving speed of the rack 27 is reduced due to the deceleration of the driving motor 261 before the rack 27 is in contact with the stopper 29, and the noise caused by the collision between the rack 27 and the stopper 253 can be minimized.

Figure 9:
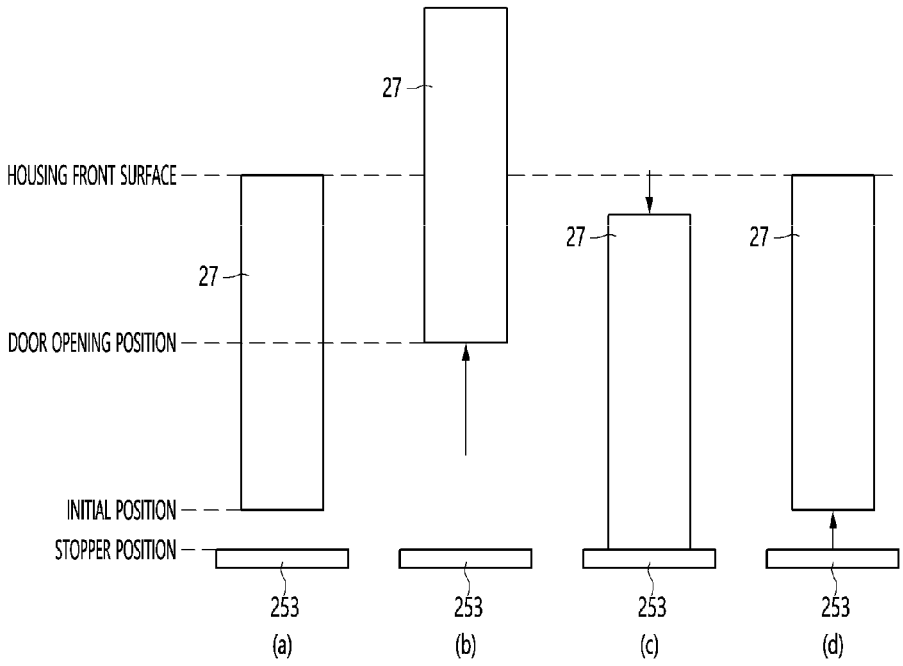
FIG. 9 is a view illustrating a state where the rack moves from the initial position to the door opening position and a state where the rack is returned from the door opening position to the initial position according to another embodiment of the present invention.

FIG. 9 is a view illustrating a state where the rack moves from the initial position to the door opening position and a state where the rack is returned from the door opening position to the initial position according to another embodiment of the present invention.

In FIG. 9, the rack is illustrated in a straight line shape for easy understanding of the movement of the rack.

The present embodiment is the same as the previous embodiment in the other portions, but differs in the method for moving the rack to the initial position. Therefore, the characteristic portions of the present embodiment will be described below.

First, with reference to (a) of FIG. 9, the initial position may be set between the door opening position and the stopper position. The position where the rack 27 is in contact with the stopper 253 can be set as the stopper position.

The front end portion of the rack 27 may be positioned on the same line as the front surface of the housing 250 in a state where the rack 27 is in the initial position.

In a state where the rack 27 is in the initial position, the rack 27 moves to the door opening position as illustrated in (b) of FIG. 9 for door opening by the rotation of the driving motor 261 in the first direction.

So as to move the rack 27 to the initial position, the driving motor 261 first rotates in the second direction and the controller 30 can determine whether or not the rack 27 reaches the stopper position as illustrated in (c) of FIG. 9.

In this embodiment, the controller 30 determines that the rack 27 moves to the stopper position and stops rotation of the driving motor 261 in the second direction when the rotation number of the driving motor during unit time is equal to or less than the stop reference number.

At this time, the moving speed of the rack 27 can be reduced before the rack 27 reaches the stopper position, so that the collision noise between the rack 27 and the stopper 253 is reduced. For example, in a state where the rack 27 is positioned at the door opening position, when the driving motor 261 rotates in the second direction, if the accumulated rotation number detected at the rotation detection unit 33 reaches the reference rotation number, the controller 30 can reduce the speed of the driving motor 261.

In this state, the controller 30 moves the driving motor 261 again in the first direction so that the rack 27 moves to the initial position.

Since the rotation number required for the rack 27 to move from the stopper position to the initial position is predetermined, when the driving motor 261 rotates in the first direction, if the accumulated rotation number rotates predetermined rotation number, the controller 30 determines that the rack 27 moves to the initial position and stops the driving motor 261.

Even in a case of this embodiment, there is an advantage that the position of the rack 27 can be accurately controlled by using the rotation number information of the driving motor 261 without any additional sensor.

The position of the rack 27 can be controlled by any one of the embodiments described above in accordance with the length of the rack 27, the size of the housing 250, and the like.

For example, in a case where the length of the rack 27 is equal to the distance from the stopper 253 to the front surface of the housing, the first embodiment can be applied. In other words, so as to align the end portion of the rack 27 with the front surface of the stopper 252 in a case where the distance from the stopper 253 to the front surface of the housing is longer than the length of the rack 27, the second embodiment can be applied.

In the present embodiment, it may be understood that change of the rotation direction and/or change of the speed of the driving motor 261 change the state of the driving motor.

For example, the controller may control the driving motor to the first state until the rack moves from the door opening position to the stopper position, and may control the driving motor to the second state until the rack moves from the stopper position to the initial position.

In the first embodiment, the first state is a state where the driving motor rotates at a first reference speed in a second direction, and a second state is a state where the driving motor rotates at a second reference speed in the second direction.

On the other hand, in the second embodiment, the first state is a state where the driving motor rotates in a second direction, and the second state is a state where the driving motor rotates in a first direction.

Alternatively, in the second embodiment, the first state is a state where the driving motor rotates in a second direction, the second state is a state where the driving motor rotates in the first direction, and, in the first state, the speed of the driving motor can be changed (for example, rack can be decelerated before reaching the stopper position).

In the embodiment described above, although the door opening device 25 is installed in the door, the door opening device 25 may be installed in the cabinet 11, and even in this case, The description described above can be applied as it is.

What is claimed is:

1. A refrigerator comprising:

a cabinet in which a storage compartment is defined;

a refrigerator door connected to the cabinet and configured to open and close the storage compartment;

a rack configured to move from an initial position to a door opening position to open the refrigerator door, wherein the initial position is a position of the rack when the door is closed and, at the initial position, the rack is located within the refrigerator door with an end surface of the rack being aligned with a surface of the refrigerator door;

a driving motor configured to generate a driving force to move the rack;

a power transmission unit configured to transmit power from the driving motor to move the rack;

a rotation detection unit configured to detect a number of rotations of the driving motor; and a controller configured to control the driving motor based on information regarding the number of rotations detected by the rotation detection unit, wherein the controller is configured to:

rotate the driving motor in a first direction to move the rack from the initial position to the door opening position, stop the driving motor based on the rack reaching the door opening position, rotate the driving motor in a second direction to move the rack from the door opening position to a stopper position, rotate the driving motor in the first direction to move the rack from the stopper position to the initial position, and stop the driving motor based on the rack reaching the initial position.

2. The refrigerator of claim 1, wherein, while the rack is moving to reach the door opening position, the controller is configured to, based on the number of rotations of the driving motor reaching a first reference number, stop the driving motor.

3. The refrigerator of claim 2, wherein, while the rack is moving from the door opening position to the stopper position, the controller is configured to, based on the number of rotations of the driving motor reaching a stop reference number, stop the driving motor.

4. The refrigerator of claim 3, wherein the controller is further configured to:

while controlling the driving motor to move the rack from the door opening position to the stopper position, reduce a rotation speed of the driving motor before the rack reaches the stopper position.

5. The refrigerator of claim 4, wherein the controller is further configured to:

while controlling the driving motor to move the rack from the door opening position to the stopper position, reduce the rotation speed of the driving motor based on the number of rotations of the driving motor detected by the rotation detection unit reaching a reference rotation number, starting from the rack being positioned at the door opening position.

6. The refrigerator of claim 3, wherein, while the rack is moving from the stopper position to the initial position, the controller is configured to, based on the number of rotations of the driving motor reaching a predetermined rotation number, stop the driving motor.

* * * * *